United States Patent [19]

Syka et al.

[11] Patent Number: 4,755,670

[45] Date of Patent: Jul. 5, 1988

[54] FOURTIER TRANSFORM QUADRUPOLE MASS SPECTROMETER AND METHOD

[75] Inventors: John E. P. Syka, Sunnyvale; William J. Fies, Jr., Portola Valley, both of Calif.

[73] Assignee: Finnigan Corporation, San Jose, Calif.

[21] Appl. No.: 914,016

[22] Filed: Oct. 1, 1986

[51] Int. Cl.[4] ..... H01J 49/34

[52] U.S. Cl. ..... 250/292; 250/291; 250/282

[58] Field of Search ..... 250/290, 291, 292, 293, 250/294, 281, 282

[56] References Cited

U.S. PATENT DOCUMENTS

| | | | |
|---|---|---|---|
| 2,939,952 | 6/1960 | Paul et al. | 250/293 |
| 3,537,939 | 11/1970 | Delaplaine et al. | 156/504 |
| 3,937,955 | 2/1976 | Comisarow et al. | 250/291 |
| 4,540,884 | 9/1985 | Stafford et al. | 250/282 |
| 4,650,999 | 3/1987 | Fies, Jr. et al. | 250/292 |

FOREIGN PATENT DOCUMENTS

| | | | |
|---|---|---|---|
| 0202943 | 11/1986 | European Pat. Off. | 250/281 |

OTHER PUBLICATIONS

Knorr, Ajami & Chatfield (Anal. Chem. 1986, 58, 690–694), Fourier Transform Time-of-Flight Mass Spectrometry.

Fisher (Z. Phys. 26, 1959, 156).

Rettinghaus (Z Angew Phys. 22, 1967, 321) (German Publication).

Peter Dawson, pp. 49–52 and 184–188, Quadrupole Mass Spectrometry and its Applications.

D. Price and J. F. J. Todd, vol. 4, Chapter 4, pp. 39–49, Dynamic Mass Spectrometry.

*Primary Examiner*—Carolyn E. Fields

*Assistant Examiner*—John A. Miller

*Attorney, Agent, or Firm*—Flehr, Hohbach, Test, Albritton & Herbert

[57] ABSTRACT

A quadrupole mass spectrometer in which a sample to be analyzed is ionized in a two or three dimensional electrostatic trapping field, and the ions in the range of the mass-to-charge ratios to be analyzed are excited at their characteristic frequencies of motion. The excited ions generate image currents which are detected and processed to provide a mass spectrum.

19 Claims, 6 Drawing Sheets

FOURTIER TRANSFORM QUADRUPOLE MASS SPECTROMETER AND METHOD

BACKGROUND OF THE INVENTION

This invention relates in general to quadrupole mass spectrometers and more particularly to a Fourier transform quadrupole mass spectrometer for simultaneously analyzing a mass range of ions.

The use of Fourier analysis in mass spectrometry is well known. The primary application of Fourier analysis methods in mass spectrometry has been in the area of Ion Cyclotron Resonance. The basic method of this technique was described in U.S. Pat. No. 3,937,955 entitled "Fourier Transform In Cyclotron Resonance Spectroscopy Method and Apparatus". More recently Knorr, Ajami & Chatfield (Anal. Chem. 1986, 58, 690–694) have described a Fourier transform method involving time of flight mass spectrometry.

The apparatus and method of mass analysis described herein is an enhancement of the technique that is referred to in the literature relating to quadrupole mass spectrometry as "mass selective detection". There are very important differences between the prior art method and apparatus and the method and apparatus of the present invention. The prior art Fourier Transform technique involves analyzing the orbital frequency of ions constrained in a large magnetic field whereas the present method and apparatus involves measuring a component frequency of the oscillatory motion of ions immersed in a radio frequency quadrupole electric field.

The earliest description of the use of the mass selective detection technique in radio frequency fields is in U.S. Pat. No. 2,939,952 which teaches both a radio frequency quadrupole mass filter and a radio frequency quadrupole ion trap. Fischer (Z. Phys., 156 (1959) 26) and Rettinghaus (Z. Angew Phys., 22 (1967) 321) built quadrupole ion trap mass analyzers based on the Paul and Stienwedel concept. A discussion of the principles of operation of the quadrupole ion trap can be found in the book "Quadrupole Mass Spectrometry and its Applications" edited by Peter Dawson, pages 49–52 and 184–188. Radio frequency quadrupole ion traps are also discussed in chapter 4, pages 39–49 of the Book Dynamic Mass Spectrometry, Vol. 4, edited by D. Price and J. F. J. Todd.

In addition to the mass analyzer based on mass selective detection two other mass analyzers have been described using RF quadrupole ion traps. Dawson and Whetten (U.S. Pat. No. 3,537,939) described a radio frequency (RF) quadrupole ion trap mass analysis method based on mass selective storage. Stafford, et al. (U.S. Pat. No. 4,540,884) described an RF quadrupole ion trap mass analysis method based on mass selective instability.

OBJECTS AND SUMMARY OF THE INVENTION

It is an object of the present invention to provide a method and apparatus in which a wide mass range of ions trapped in a radio frequency field can be simultaneously analyzed.

It is another object of the present invention to provide a Fourier transform quadrupole mass spectrometer.

It is a further object of the invention to provide a method and apparatus for trapping and analyzing a broad mass range of ions in a radio frequency field such as found in a quadrupole mass filter or quadrupole ion trap.

In accordance with the present invention the forced excitation and detection step in a quadrupole ion trap is separated and Fourier analysis techniques are employed to simultaneously detect and mass analyze trapped ions over a range of mass to charge ratios.

In accordance with the invention a wide mass range of ions are formed and trapped in a radio frequency trapping field, the ions are then excited by applying a pulse of electrical force to the ions such that it imparts into the ions coherent motion, the characteristic motion of various mass to charge ratios is detected and recorded and the recorded signal is frequency analyzed to provide a frequency spectrum which corresponds to a mass spectrum.

Also in accordance with the invention a wide mass range of ions are formed and trapped in a radio frequency trapping field, the ions are then excited by applying a pulse of electrical force to the ions such that it imparts coherent ion motion. The composite image current signal induced by the motion of the various trapped ions is detected and recorded. This recorded signal is frequency analyzed to provide a frequency spectrum, and then the frequency spectrum is converted to a mass spectrum by relating the frequency of the spectral lines to the characteristic frequencies of motion that various mass-to-charge ratios have within the trap.

BRIEF DESCRIPTION OF THE DRAWINGS

The foregoing and other objects of the invention will be more clearly understood from the following description taken in conjunction with the accompanying drawings wherein.

DETAILED DESCRIPTION OF THE INVENTION

Figure 1:
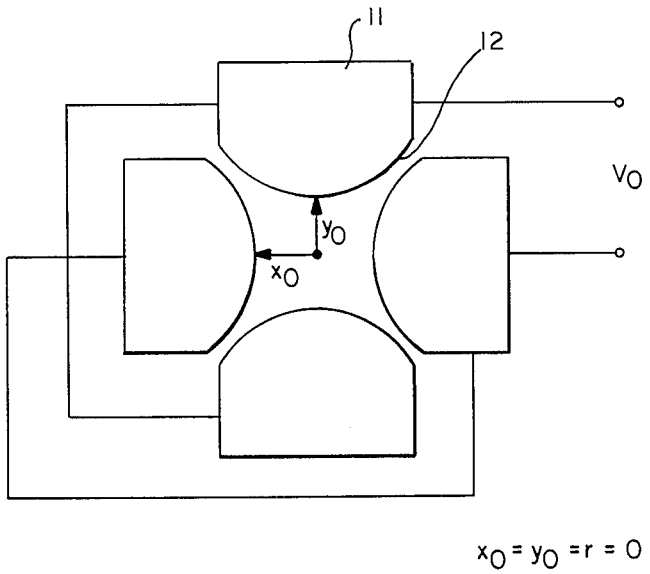
FIG. 1 is a sectional view of a two dimensional quadrupole structure.

While the basic theory of operation of RF quadrupole field devices, as mentioned earlier, is well established, some discussion is needed to explain the new method and apparatus herein described.

An electrostatic quadrupole field is an electric field of the form $$\vec{E}=E_o(\lambda_x x\hat{i}+\lambda_y y\hat{j}+\lambda_z z\hat{k}) \quad (1)$$

where $\lambda_x$, $\lambda_y$, and $\lambda_z$ are constants and $E_o$ may be time variant. In the absence of space charge, real electrostatic fields must conform to the Laplace condition $$\vec{\nabla}\cdot\vec{E}=0 \quad (2)$$

so $$0=\lambda_x+\lambda_y+\lambda_z. \quad (3)$$

If $\lambda_z=0$ then it is a two dimensional quadrupole field. This is the type of field used in the RF quadrupole mass filter. If $\lambda_x=\lambda_y$ then it is a rotationally symmetric three dimensional quadrupole field which is the sort most commonly used for the RF quadrupole ion trap. The characteristic of the quadrupole type field that makes it unique is that the equations of motion of an ion in such a field are decoupled. For an ion of mass, m, and charge Ze, the equation of motion for the ion is:

$$\vec{F}=m\vec{A} \quad (4)$$

$$-\underline{Z}eE=m\vec{A} \quad (5)$$

separating this equation in each direction one gets an equation of the form $$-\underline{Z}eE_o\lambda_u u=F_u=m\ddot{u} \quad (6)$$

for the x, y and z components of motion. Since the force acting on an ion in one dimension is only a function of displacement in that dimension its motion in that dimension is independent of motion in the other two dimensions.

Figure 2:
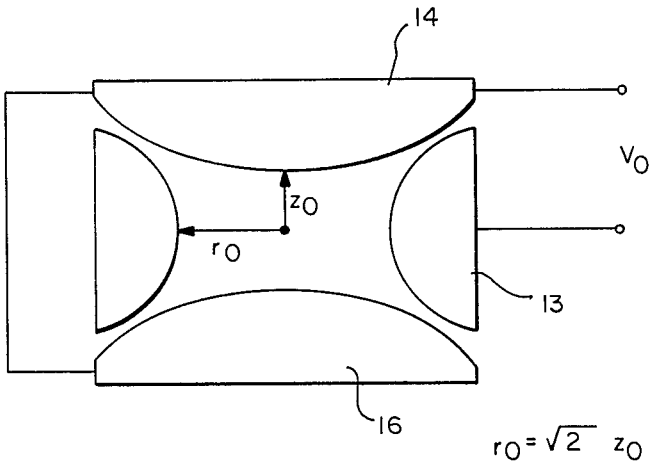
FIG. 2 is a sectional view of a three dimensional quadrupole structure.

Quadrupole fields may be generated by electrode structures having appropriate hyperbolic contours. The hyperbolic character of the electrodes arises from the integration of the quadrupole field equation which yields a potential field with iso-potentials that have hyperbolic profiles. For the two dimensional quadrupole field the appropriate electrode structure consists of parallel rods 11 with their inside surfaces 12 hyperbolically contoured as shown in FIG. 1. Opposite electrodes are electrically connected together. For the radially symmetric three dimensional quadrupole field the appropriate structure consists of three parts: a ring electrode 13 and two opposing end caps electrodes 14,16 (FIG. 2). The interior facing surfaces of these electrodes have the appropriate hyperbolic shape. The size of the electrode assembly is generally defined by a characteristic dimension, $r_o$, which is related to the spacings of the hyperbolic surfaces from the axis or center of the device. The fixed relationship between $r_o$ and $x_o$, $y_o$ or $r_o$ and $z_o$ shown in FIGS. 1 and 2 are only specific to the devices shown.

In terms of device size, $r_o$, and applied voltage, $v_o$, the equations of motion become of the form $$-\underline{Z}e\frac{V_o}{r_o^2}\lambda_u U = m\ddot{u} \quad (7)$$

or $$m\ddot{u} + ze\frac{V_o}{r_o^2}\lambda_u U = 0 \quad (8)$$

The applied voltage, $V_o$, is, in general, comprised of a fixed or DC part, U, and a variable or RF part, V cos ωt. Hence $$V_o=U-V\cos\omega t. \quad (9)$$

and the equations of motion for ions in such a device become $$u + \frac{e\lambda_u}{(m/Z)r_o^2}(U - V\cos\omega t)u = 0 \quad (9.5)$$

This type of differential equation is well characterized and is known as the Mathieu equation. The canonical form of the Mathieu equation is given below.

$$\frac{d^2u}{d\xi^2} + (a_u - 2q_u\cos 2\xi)u = 0 \quad (10)$$

Solutions to the Mathieu equation fall into two classes: Stable and unstable. Unstable solutions are those for which the displacement, u, grows without bounds as the time variable, ϵ, increases. Stable solutions are those for which there is a finite limit that the displacement, u, may attain independent of the time variable, ϵ. In terms of ion motion in a quadrupole field, ions that have equations of motion with unstable solutions will have displacements that grow with time and cause them to be ejected from the device. Ions that have equations of motion with only stable solutions will have oscillating trajectories about the field axes and, provided that these oscillations are not too large, will be contained or trapped in the device. Whether such an equation of motion is stable or unstable is determined solely by the parameters of the Mathieu equation $a_u$ and $q_a$. For the devices under consideration these parameters are given as $$a_u = \frac{4eU\lambda u}{(m/Z)r_o^2\omega^2} \quad (11)$$

$$q_u = \frac{2eV\lambda u}{(m/Z)r_o^2\omega^2} \quad (11)$$

The combinations of $a_u$ and $q_u$ that produce stable solutions are well known.

For trapping of ions in a quadrupole device as is necessary for mass analysis the ions must have stability in all dimensions of the quadrupole field. It turns out that this situation can only be achieved if the applied voltage is in part a radio frequency voltage. In fact the most basic case is when no fixed voltage is applied ($a_u=0$) and only RF trapping voltage is applied. Under these circumstances ions within the device will, for practical purposes, have stability only if $q_x$, $q_y$ and $q_z$ (if appropriate) are less than cu. 0.91. Since $q_u$ varies inversely with m/z, for a given applied RF voltage, V, of frequency, ω, and device size, $r_o$, all ions with mass to charge ratios above some cutoff mass to charge ratio will have stability and can potentially be constrained in the device. The application of a DC voltage, U, along with the RF voltage ($a_u \neq o$) introduces a lower limit as well as an upper limit to the range of $q_u$'s that correspond to stable ion motion in all directions. Hence there is a range of mass to charge ratios that ions can have between some upper and lower threshold mass to charge ratios that will have stable motion and can be constrained within the device. If a sufficiently large amount of DC voltage is applied relative to the RF voltage applied, simultaneous stability in all directions may not be possible and no ions will be trappable.

For purposes of mass analysis one needs only to consider the case in which ions are trappable. As mentioned earlier, trapped ions have oscillatory motion about the center of the device. In any one direction an ion's motion can be considered as the sum of an infinite series of sinusoidal oscillations. The frequencies of these constituent oscillations are defined by characteristic parameter, $\beta_u$, and the frequency, $\omega$, of the RF voltage applied to generate the trapping field. These component frequencies fall in a well defined sequence $$\frac{\beta}{2}\left(1-\frac{\beta}{2}\right)\omega, \left(1+\frac{\beta}{2}\right)\omega, \left(2-\frac{\beta}{2}\right)\omega, \left(2+\frac{\beta}{2}\right)\omega \ldots \left(N-\frac{\beta}{2}\right)\omega, \left(N+\frac{\beta}{2}\right)\omega \quad (13)$$

The parameter, $\beta_u$, is solely a function of the Mathieu parameters $a_u$, $q_u$ associated with the particular ion in the defined trapping field. The relationship between $a_u$, $q_u$ and $\beta_u$ in general, cannot be expressed in closed form and is usually expressed as a continued fraction. For purposes of this disclosure it is sufficient to state that there are numerical methods that allow very precise calculation of $\beta$ for a given $a_u$ and $q_u$. If one is considering ions of a single charge polarity then for a given set of trapping conditions (U, V, $\omega$, $r_o$) the mass to charge ratio of an ion corresponds uniquely to a single $\beta$ value. Hence the component frequencies of ion motion are unique and specific to particular mass to charge ratio. The determination of a component frequency of the motion of an ion contained in a RF quadrupole field device combined with knowledge of the operating parameters of the device, U, V, $\omega$ and $r_o$, constitutes mass analysis. This is the basis of the mass selective detection methods for mass analysis using RF quadrupole field devices.

The relative magnitude and phase of the constituent oscillation are fixed and are determined by the Mathieu parameters $a_u$, $q_u$ associated with the particular ion of interest. Typically the constituent oscillations corresponding to the first three frequencies in the sequence, $\beta/2\omega$, $(1-\beta/2)\omega$ and $(1+\beta/2)\omega$, account for most of the motion of an ion. For low values of $q_u$ and $a_u$ the lowest frequency component of motion predominates so such ions can be considered undergoing simple harmonic motion. In these circumstances the Mathieu equation can be simplified to yield the following:

$$\frac{d^2u}{d\xi^2} + \beta^2 u = 0 \quad (14, 15)$$

where $$\beta_u^2 = a_u + \frac{q_u^2}{2}$$

This linear differential equation with constant coefficients is very well known and is associated with many physical systems. It describes the oscillatory motion of a mass on an undamped spring. It also describes the oscillation or ringing of a voltage across a lossless tuned (LC) circuit. In the time domain this equation is given as $$\ddot{u} + \beta^2 \frac{\omega^2}{4} u = 0 \quad (16)$$

and it has a general solution of the form $$u(t) = u_o \cos\beta \frac{\omega}{2} t + \dot{u}_o \frac{2}{\beta\omega} \sin\beta \frac{\omega}{2} t \quad (17)$$

where $U_o$ and $\dot{U}_o$ are the initial values of displacement and velocity respectively. The solutions to the unsimplified Mathieu equation are of similar form in that the cosine and sine terms are substituted with corresponding infinite series of cosine and sine terms having the previously described sequence of frequencies. For purposes of explanation of the operation of the prior art methods of mass analysis and the new method herein described, this simplified harmonic model of ion motion in the RF quadrupole field is useful.

In using the characteristic frequencies of ion motion in RF quadrupole field device for mass analysis one must have means to detect the frequency of the ion motion. As in the case of ion cyclotron resonance methods this can be accomplished through the detection of what are termed image currents in the field defining electrodes induced by the motion of ions within the device. These ion image currents occur because of the capacitive coupling between a trapped ion and the surrounding conductive electrodes. As an ion approaches an electrode, charges of the opposite polarity accumulate in the electrode because of the increased coulombic force from the ion. As the ion moves away from this electrode toward the opposite electrode, the induced charged dissipates from the first electrode and charge accumulates on the opposite electrode. The induced image current to an electrode, therefore is an AC current having component frequencies which correspond to the component frequencies of the ion motion in the direction that moves the ions alternately near and far from the electrode. The magnitude of the induced current is, to first order, proportional to the frequency and magnitude of the ions oscillating trajectory. The relationship between an ion's motion and induced current is, to varying degrees, non-linear so that harmonics of the constituent frequencies of an ion's motion will also be observed in the image current.

The image current induced by a single ion is very small and therefore difficult to detect. However, the aggregate of image currents of thousands or millions of ions is a detectable signal. For this to be so the ions must be moving in concert or, in other words, in phase. As ions are originally trapped they have random initial conditions and hence have random phase; that is for every ion approaching one electrode there is probably a corresponding ion directed toward the opposite electrode. The result is that the image currents of the two ions substantially cancel each other. To detect many ions the ions must, at least in part, be moving coherently (in phase).

As in the case of ICR experiments, trapped ion motion within the RF quadrupole field can be made coherent by driving the ions with some supplementary position independent force. This additional force adds an inhomogeneous term to the differential equations of motion of the ions so the equations become of the form $$\frac{d^2u}{d\xi^2} + (a_u - 2q_u)\cos 2\xi = P(\xi). \quad (18)$$

For the simplified case where $q_u$ is less than 0.4 and $a_u$ is small then one has equations of motion (in the time domain of the form:

$$\ddot{u} + \beta^2 \frac{\omega^2}{4} u = P(t) \tag{19}$$

The solution to such equations of motion are of two parts. The first part is the motion an individual ion would have had anyway if no driving force were applied (Equation 17). The second part is the additional motion caused by the driving force. This component is independent of initial velocity or displacement of the particular ion and thus is common to all ions of the same m/Z within the trapping field subject to this force. The portion of image current due to this forced motion will add constructively with that of other ions of the same mass-to-charge ratio.

The size and character of the forced response is dependent upon the amplitude and frequency distribution of the applied force. In considering the case where the applied force is sinusoidal, resonance will occur when the frequency of the driving force matches that of characteristic frequency, $\beta\omega/2$, of the ion. In this resonant case, the forced motion will be a sinusoid with a frequency equal to the resonant frequency but its amplitude will grow linearly in an unbounded fashion. If the applied frequency is different from that of the characteristic frequency of the ions motion then the driven motion will be bounded and have components of both the drive frequency and characteristic frequency. In general, the response of an ion to the excitation force will only be large for drive frequencies close to its resonant frequency. In the more general case where the driving force waveform is something other than a pure sinusoid, the magnitude of the forced motion, will be dependent on the extent that waveform consists of frequencies close to the characteristic frequency for the particular mass-to-charge ratio.

Up to this point the forced excitation of ions has been discussed in reference to the case where ion motion is substantially harmonic (sinusoidal). However, the basic principles apply in an analogous fashion in the general case. Resonance will occur if the driving force has a frequency equal to any one of the series of characteristic frequencies of an ion's motion ($\beta\omega/2$, $(1-\beta/2)^{\omega}$, $(1+\beta/2)^{\omega}$ etc.). The coupling will be strongest at the component frequency that dominates the ion motion. Minimal coupling occurs if the drive frequency is not close to one of the resonant frequencies.

In practice the driving force is generated by applying a supplementary AC voltage across an opposing pair of electrodes of the quadrupole structure. In the case of the ion trap instruments of Fischer & Rettinghaus the AC excitation or drive voltage was applied between the end cap electrodes of the trap structure. To first order this generates a homogeneous electric field component along the axis of the device, as the end caps behave approximately as the plates of a parallel plate capacitor.

The instruments of Fischer & Rettinghaus worked in a fashion analogous to the early ion cyclotron resonance instruments. Ions were trapped, a sinusoidal excitation voltage was applied, the RF and DC voltages were manipulated to bring successive mass-to-charge ratios into resonance, and the image currents of the resonating ions were detected and recorded. Fischer used the simplest form of image current detection, he measured the power absorbed by the ions as they were brought into the resonance. Rettinghaus used more sophisticated electronics and detected and rectified the image current signals. In either case the sequence of peaks in power absorption or image current amplitude corresponded to a mass spectrum of the range of ions brought into resonance. The main drawback to this type of scheme is that in order to have sufficient resolution to distinguish signals corresponding to ions of adjacent mass-to-charge ratios, one must scan rather slowly. As an absolute maximum, the scan time per peak must be greater than the reciprocal of the frequency difference between the characteristic frequencies of ions of consecutive mass-to-charge ratios to be differentiated. In practice one might scan a factor of ten slower than this rate. Since higher resolution is required to resolve adjacent masses at higher mass-to-charge ratios (the spacing of frequencies is closer) the scan rate must slow with increasing mass. To scan over a wide range of mass-to-charge ratios can be a time consuming procedure.

The present invention involves a method and apparatus for separating the forced excitation and detection steps and applying Fourier analysis techniques to simultaneously detect and then mass analyze trapped ions over a range of mass-to-charge ratios. The steps of this method are as follows: (1) The trapped ions are excited to coherent motion by applying and excitation waveform whose frequency distribution includes the frequencies corresponding to characteristic frequencies of motion for all trapped ions of the range of mass-to-charge ratios to be analyzed. The applied excitation is of a finite duration; (2) after excitation has ceased, the ion image current signal that persists is detected, amplified and recorded. Recording continues as long as the ion image currents persist or for a sufficiently long time to provide the desired frequency/mass resolution; (3) The record of the ion image current signal is then frequency analyzed (generally using Fourier analysis techniques) and a frequency spectrum is obtained. Since no excitation occurs at the time of recording, the coherent motion created by the excitation pulse is strictly that induced by ions moving in their characteristic modes in the unperturbed quadrupole field. The detected ion image current signal is the aggregate of the image currents of all ions excited within the trap. Spectrum analysis breaks the signal up into the constituent frequencies that correspond to the characteristic frequencies of motion of the ions in the quadrupole field. The frequency spectrum can be transformed to a mass spectrum by the known relationships between quadrupole field parameters and in characteristic frequencies. This method, as mentioned before, is in many ways analogous to the FT ICR method. Aside from the important fact that no magnetic fields whatsoever are involved there are some other differences. One is it is not restricted to exciting and detecting ions at the same frequency. As mentioned before ions have multiple characteristic frequencies. Hence, one could, for example, excite ions with a waveform composed of frequencies corresponding to the $(1-\beta/2)\omega$ band of characteristic frequencies of ions and detect the induced image current transient in a frequency range corresponding to the $\beta/2\omega$ band of characteristic frequencies of ions.

Another distinctive feature about using quadrupole fields is that one can easily control the range of ions trapped within the device. The RF and DC voltages applied to generate the quadrupole trapping field can be manipulated so as to render unstable wide ranges of undesired ions, thus quickly eliminating them from the trap. Of course, the method of resonating ions out of the trap is available as it is for the FT ICR devices.

Another advantage of using quadrupole fields is that trapped ions having well established trajectories will relax to the center of the field when they undergo collisions with neutral background gas molecules. For ions trapped within the DC potential/magnetic field of an ICR cell, collisions with background gas molecules cause ions to diffuse out of the trapping cell and be lost. Hence, trapping times at any given background pressure should be longer for the RF quadrupole devices than for ICR cells.

To obtain the frequency dispersion at high masses necessary to obtain the required mass resolution, the modern FT ICR instruments use superconducting solenoids magnets to generate large magnetic fields with intensities in the order of 2–7 tesla. Equivalent in characteristic frequency dispersions for high mass ions can be obtained with conventionally sized ($r_o \approx 1$ cm) RF quadrupole field devices operating at conventional frequencies ($\sim 1$ MHZ) and with reasonable applied RF voltages (1–7 KV).

In practice, the attainable resolution will be limited by a number of considerations. Collisions with neutral background gas molecules will dephase and damp the initially coherent motion of excited ions shortening the induced ion image current signal duration. Also imperfections in the quadrupole field will cause ions of the same mass-to-charge ratio to have characteristic frequencies that vary slightly with position in the trap. This too will result in dephasing of coherently excited ions and reduce resolution. Field imperfections due to the space charge from large numbers of trapped ions also deteriorates performance by causing bulk characteristic frequency shifts. Also, space charge can cause the coherent motion of ions of adjacent mass-to-charge ratios to couple so that the two ion species oscillate at a common characteristic frequency. The major drawbacks to the technique are isolating the input of the amplifier used to detect the ion image currents from the high RF voltage applied to generate the trapping field and providing a sufficiently good approximation to a perfect quadrupole field.

Now that the theory of operation of a quadrupole ion trap in accordance with the invention has been described, the mass spectrometer will be described.

Figure 3:
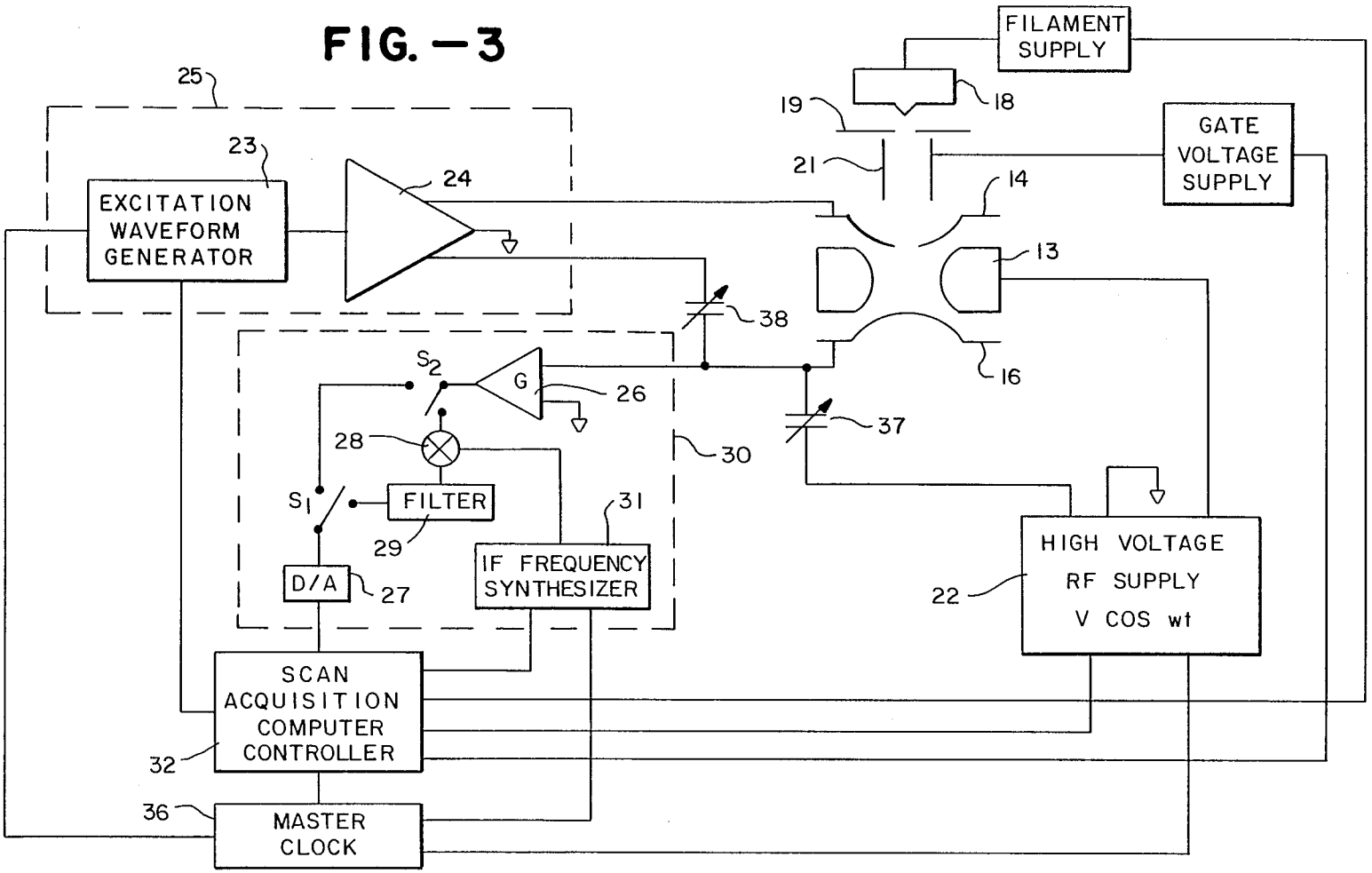
FIG. 3 is a block diagram of a three dimensional quadrupole mass spectrometer in accordance with one embodiment of the invention.

The mechanical component of the mass spectrometer, FIG. 3, consists of a quadrupole electrode structure 13,14,16 and an electron gun having a filament 18 to produce electrons, an aperture plate 19 and a gate electrode 21 to control the transmission of electrons into the RF quadrupole ion trap through end cap 14.

The electronic control, detection and analyzing circuit can be broken into six main blocks, a frequency stable high voltage supply 22 with differential output, a set of excitation pulse electronics, 25, including excitation waveform generator 23 and drive amplifier 24, a set of detection electronics, 30, including amplifier 26, digital-analog converter 27, mixer 28, filter 29 and frequency synthesizer 31, a scan and acquisition computer controller 32, electron gun power and gate voltage supplies 33,34 and a frequency stable master clock 36.

The RF voltage supply 22 drives the ring electrode to create the trapping field. This supply has a differential output. The second output, having the opposite phase, is connected to the end cap through a small variable (trimmer) capacitor 37. This capacitor is adjusted so as to null the small amount of voltage induced in this end cap due to the capacitive coupling between the ring electrode and the end cap. The operating frequency, $f_o$, ($\omega = 2\pi f_o$), of this supply is fixed and is referenced to the system's master clock. Generally, this frequency should be a sub harmonic of the master clock frequency. The RF amplitude is variable and can be externally controlled by the system's scan and acquisition computer controller.

The excitation pulse electronics, 25, consists of two components, an excitation waveform generator 23 and a differential driver amplifier 24. The waveform generator 23 creates the waveform used to excite the trapped ions to coherent motion. This wave form may range from an impulse, to a short sinusoidal burst, to a chirp (constant amplitude frequency sweep), to a waveform specifically designed to give equal excitation power to all frequencies within a certain frequency range corresponding to the mass range of ions to be analyzed. The choice of the frequency range of these excitation waveforms must correspond to the band of either the first, $\beta/2\omega$, second, $(1-\beta/2)\omega$, third order, $(1+\beta/2)\omega$, or higher order frequencies of the motion along the Z axis of the trapped ions that are to be mass analyzed. The excitation pulse waveform is fed to a differential output driver amplifier 24. This driver amplifier magnifies the excitation waveform sufficiently so that a sufficient amount of ion motion is induced to allow detection of the resulting ion image currents. One polarity of the output of this amplifier is connected to the "excitation" end cap 14 and actually provides the voltage that drives the trapped ions in the z direction. The other polarity output is connected to the opposite "detection" end cap 16 through a small variable (trimmer) capacitor 38. This variable capacitor is adjusted so as to null the induced voltage on the "detection" end cap due to capacitive coupling between it and the "excitation" end cap.

The detection electronics 30 amplifies the ion image current signal and digitizes it. This set of electronics consists of five main components, a high gain broad band small signal amplifier 26, a multiplier/mixer 28, a low pass filter 29, an analog to digital converter 27, and an intermediate frequency (IF) synthesizer/generator 31.

The input to the high gain amplifier is connected to the "detection" end cap. As mentioned before care must be taken to null contributions to the signal at the input of this amplifier due to capacitive coupling from the ring electrode and an "excitation" end cap electrode. This is necessary because the image current signal from the trapped ions is very small and can easily be overwhelmed by such interfering signals. Also, the gain of the amplifier is quite high, and, if not nulled the relatively large signals coupled from the ring and excitation end cap could drive it into saturation.

The output of the amplifier can be either connected directly to the A/D converter for digitization or it can first be "mixed" down to a lower frequency using a conventional heterodyne arrangement consisting of the multiplier/mixer module, the frequency synthesizer/local oscillator and the low pass filter. This hyterodyne down convertor allows digitization to occur at a lower rate. Generally, direct digitization would be used if one is analyzing over a wide mass/frequency range. The hetrodyne mode is useful for analysis of a narrow range of masses/frequencies as the lower signal frequency allows sampling at lower rate and therefore for a longer time if one is restricted to a limited number of samples for each experiment. A basic principle in the theory of frequency analysis is that frequency resolution attainable is proportional to the time spent observing the signal. Hence, the heterodyne mode allows far higher resolution analysis albeit over a smaller frequency range. This of course assumes that the sampling time is limited by the total number of samples that can be stored rather than the duration of the ion image current transient signal. The frequency produced, by the synthesizer/local oscillator is also referenced to the system master clock frequency.

The scan and acquisition controller/computer controls the sequencing of the experiment, acquires and stores the data and performs the Fourier transform analysis of the data to produce a frequency spectrum and then a mass spectrum.

The electron gun electronics consists of an emission regulated power supply 33 for the filament and a switching voltage supply 34 to drive the gate electrode. The filament supply drives current through the filament to heat it and biases the filament assembly at a negative voltage relative to the end cap so the emitted electrons are driven toward the end cap. The gate electrode supply and output switches between positive and negative voltages. To allow ionization, the gate supply biases the gate electrode positively so that electrons may transit to the end cap and on into the ion trap to ionize sample neutral molecules. To prevent ionization during the analysis time, the gate supply biases the gate electrode negatively, retarding the electron beam, and preventing it from reaching the interior of the ion trap.

The master clock 36 provides a time, phase and frequency standard for the apparatus. This allows for accurate reproduction of experimental conditions and also makes possible signal averaging of acquired ion image current transient data prior to spectrum analysis. For such signal averaging to improve the signal-to-noise ratio, the start, the duration, and the waveform of the excitation pulse, the frequency and initial phase of the RF voltage applied to the ring electrode; the frequency and initial phase of the synthesizer/local oscillator (if operating in the heterodyne mode), the timing of the onset of data acquisition and the sampling (A/D conversion rate) rate need to be highly reproducible and stable.

Figure 4:
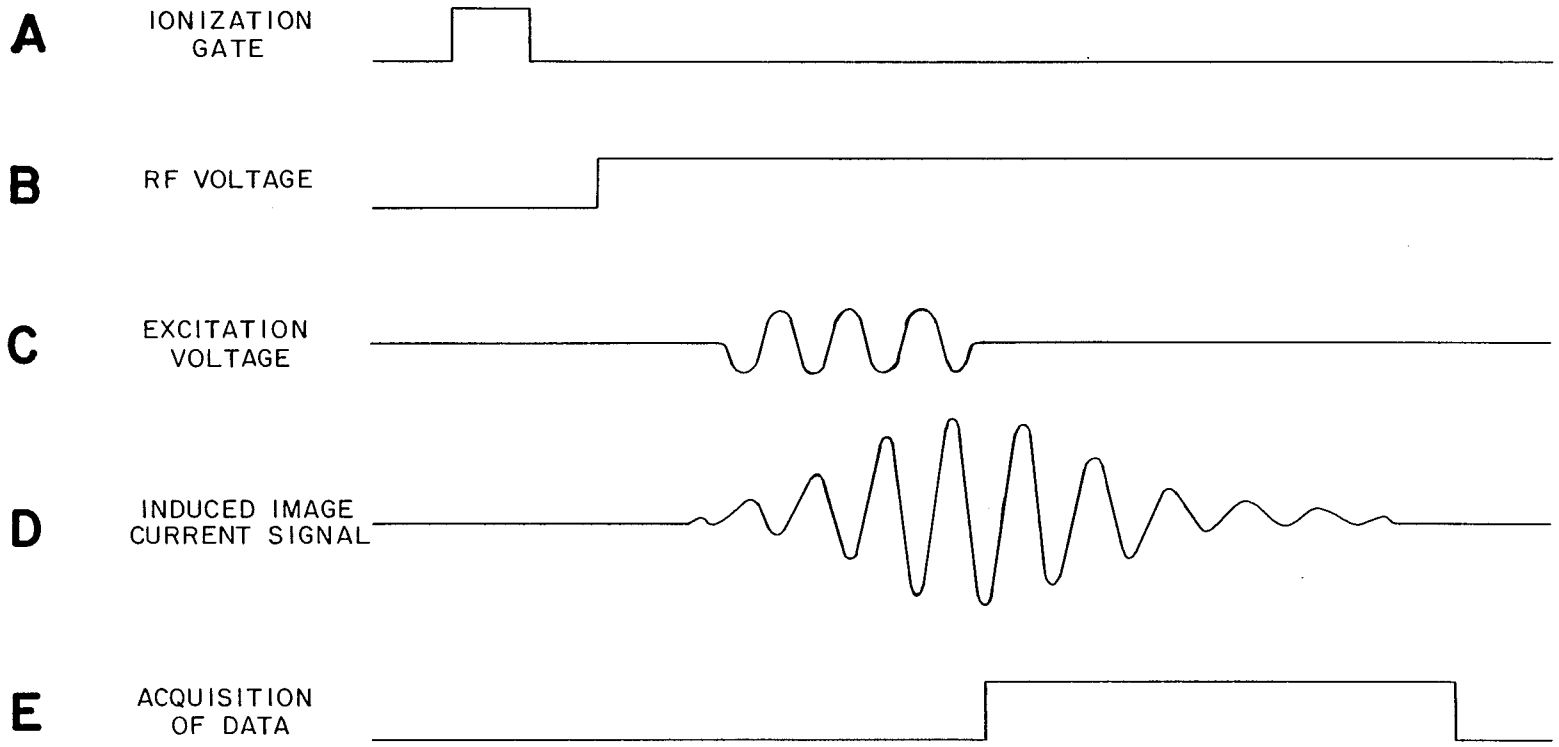
FIG. 4 shows a timing diagram for the operation of a quadrupole in accordance with the present invention.

The following is an example of how mass analysis is performed with the described apparatus. Referring to FIG. 4, the RF voltage, B, is initially set to some level appropriate for efficient trapping of ions in the mass range of interest. The gate electrode is biased, A, to allow electrons to enter the trap and ionize sample molecules in the interior of the trap. The pressure inside the ion trap analyzer must be maintained below $1\times10^{-5}$ torr and most desirably below $10^{-8}$ torr as is the case for FT ICR. The electron beam is gated into the device long enough so that a large number of ions can accumulate. After ionization has ceased the RF voltage is changed to bring the z axis motion of the trapped ions of interest into the frequency range desirable for detection and analysis. In many cases the ionization RF voltage level may be suitable and no change in the RF voltage level is necessary. After allowing the RF level to stabilize the excitation pulse voltage, C, is applied to the "excitation" end cap. This produces coherent motion along the z axis for trapped ions with characteristic frequencies of motion within the frequency band of the excitation pulse. The excitation waveform is chosen so as to excite all ions within the mass range of interest. After the end of the excitation pulse the digitization and storage of the ion image current transient signal, D, from the "detection" end cap begins. Generally, there should be a short delay between the end of the excitation pulse and the recording of the first digitized sample so as to insure that the amplifier has recovered from any "feed-through" from the excitation pulse and gives undistorted amplification of the ion transient signal. Generally, the digitization should continue until either the ion image current transient has completely ceased or, if the transient signal is long lived, one is able to acquire long enough to obtain the desired frequency/-mass resolution. The digitized data is stored in the memory of the scan and acquisition computer controller.

Prior to performing the next mass analysis experiment the ions from the previous experiment should be eliminated. This can be accomplished by setting the RF voltage to zero so there is no longer any trapping field. It should be possible to excite and detect ions for a second time after once having excited and detected them. However, there is generally no reason to do this.

After the acquisition of the digitized ion transient data is complete, the computer controller converts the time domain raw data into a frequency spectrum using well known techniques from field of digital signal processing. Generally, this involves obtaining the discrete Fourier transform of the acquired data set or some filtered, windowed, phase corrected or otherwise processed form of that data set. The techniques for doing this are, to reiterate, well known and are similarly applied to ion transient data acquired from FT ICR instruments. Once the frequency spectrum is obtained the computer/controller can correlate the measured frequencies with masses based on the known relationships between ion mass-to-charge ratios, RF field frequency, field intensity and the characteristic frequencies of ion motion along the z axis of the device. Thus, the frequency-intensity profile of the ion transient frequency spectrum is transformed into the mass (mass-to-charge ratio)-intensity profile of a mass spectrum. Typically the RF voltage applied to the ring electrode is known with far greater precision than accuracy. Hence, calibration is required prior to analysis of unknowns. This is accomplished by analyzing a compound having a known mass spectrum with mass peaks having accurately determined mass-to-charge ratios. For a given RF voltage setting the frequency spectrum of this standard compound allows calculation of the effective quadrupole field strength.

While the apparatus described excites trapped ions in their z axis mode of oscillation and detects the resulting ion image current transient current signal on an end cap, this is not the only possible arrangement. One alternate configuration would require applying the trapping RF voltage to the end caps and mechanically splitting the ring electrode into two electrically isolated halves. This configuration would allow excitation of trapped ions in either their x axis or y axis modes of oscillation. The excitation pulse would be applied to one half ring electrode and an induced ion image current transient signal would be detected with the other. To excite the x axis mode of oscillation of trapped ions the ring electrode would be split in the y,z plane. To excite y axis mode of oscillation of trapped ions the ring electrode would be split in the x,z plane.

The previously described analyzers employ what is known as single ended detection. The image current induced to one of two opposing electrodes is measured.

An alternative approach is to detect the induced ion image current signals to both opposing electrodes and amplify the difference. Since these two induced ion signals are of opposite phase, the resultant difference signal has about twice the amplitude of the signal that would be obtained using the single ended approach. In addition to this increase in sensitivity, this approach has another advantage. There is less spatial dependence (distortion) in the relationship between ion motion (velocity) and the resultant net induced ion image current signal. For FT ICR analyzers differential detection is the preferred method. For the FT RF quadrupole analyzers herein described, utilizing differential detection involves some complexity. One or both of electrodes used for detection must also have the excitation waveform applied to them immediately prior to being used for detection. Therefore, some fast switching means must be provided to switch the connection of one or both electrodes from the output(s) of the excitation waveform driver amplifier to the input(s) of the high gain amplifier of the detection electronics. Such a switching means must provide a very high degree of isolation between the driver amplifier and the input amplifier particularly during the recording of the ion transient signal because even a small amount of feed through of noice from the excitation electronics could easily overwhelm the extremely low level ion transient signals.

Figure 7:
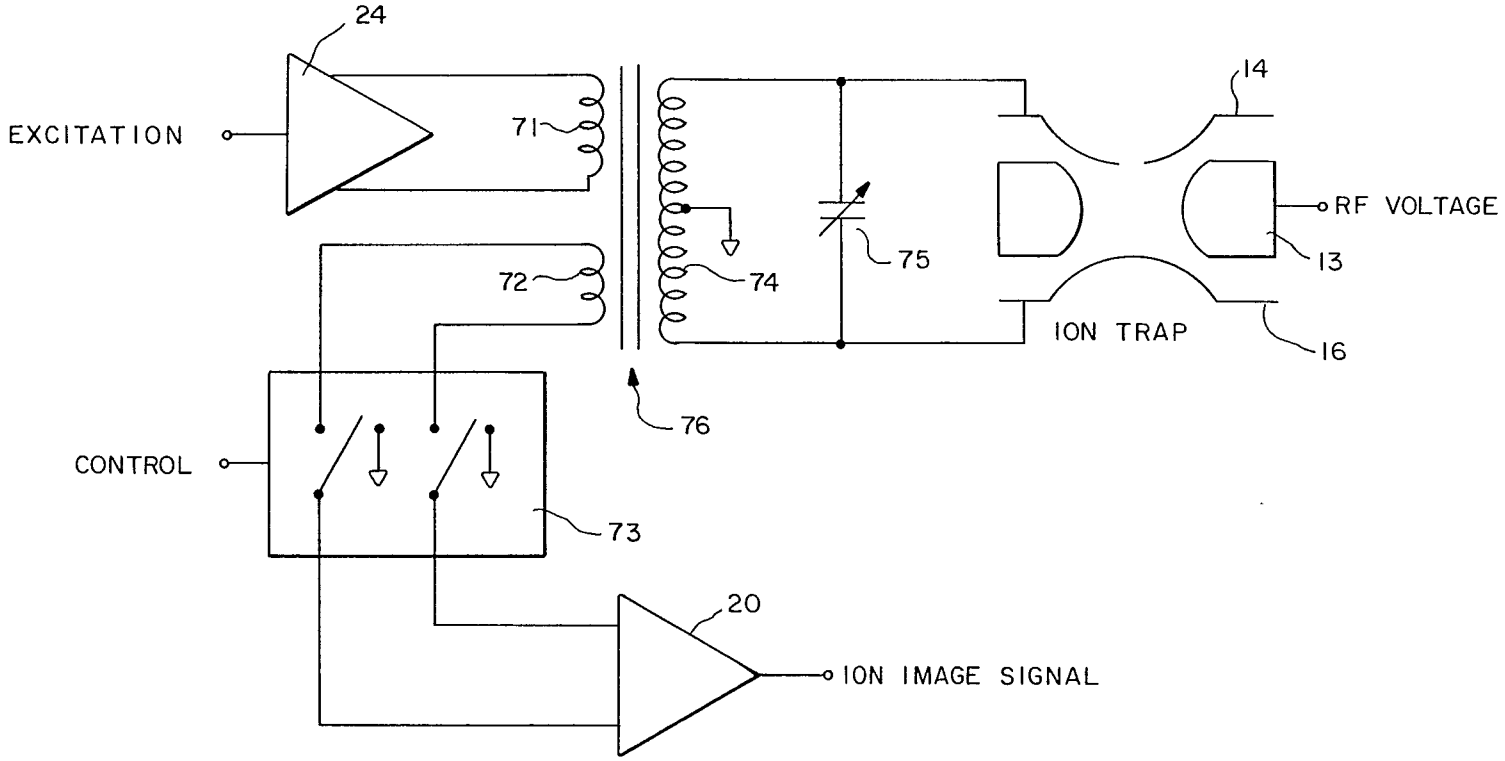
FIG. 7 is a block diagram of a differential detector for a mass spectrometer like the one shown in FIG. 3.

One such arrangement for differential detection is shown in FIG. 7. Like reference numbers have been applied to like part. The differential drive amplifier, 24, and the high gain amplifier, 26, are electrically connected through a tuned transformer, 76 to the end caps, 14,16, of the ion trap. The electrical connection between the high gain amplifier and the tuned transformer is through a switching means, 73, that allows the inputs of the amplifier to be either electrically connected to the end caps via the transformer 76, or grounded. During the excitation step the inputs of the high gain amplifier are disconnected from the secondary, 72, of the tuned transformer and grounded and thus are protected from the excitation voltage. The proportion of the voltage output from the differential driver amplifier that is actually produced on the end caps of the ion trap will depend on the coupling of the secondary, 71, with the primary, 74, of the transformer. A variable capacitor is connected across the transformer primary. The inductance of the transformer and the capacitance of the variable capacitor and end caps creates a LC resonant circuit. If the excitation waveform consists of frequencies within the pass band of this resonant or tuned circuit then the coupling of the driver amplifier to the end caps is high. If the excitation of the waveform consists of frequencies outside the relatively narrow pass band of the transformer then the coupling of the driver amplifier is poor and the amplitude of the driver amplifier output must be substantially higher if enough voltage will be produced between the end caps to sufficiently excite trapped ions.

During the detection step no voltage is output from the driver amplifier and the switching means electrically connects the high gain amplifier to the transformer to amplify the differential ion image current signal from the end caps of the ion trap. Only ion image current signals of frequencies within the narrow pass band of the tuned transformer will be detected. The relatively narrow bandwidth of the transformer therefore limits the mass/frequency range of ions that can be detected and analyzed in any one experiment. The capacitor, 75, is made variable so as to provide some adjustment to the range of image current frequencies that can be detected. An advantage of this arrangement is that the narrow bandwidth of the tuned transformed provides substantial isolation of the high gain amplifier from the RF voltage on the end caps produced by capacitive coupling of the RF trapping voltage applied to the ring electrode. No nulling capacitors, as used in the previously described arrangement need be used.

Figure 5:
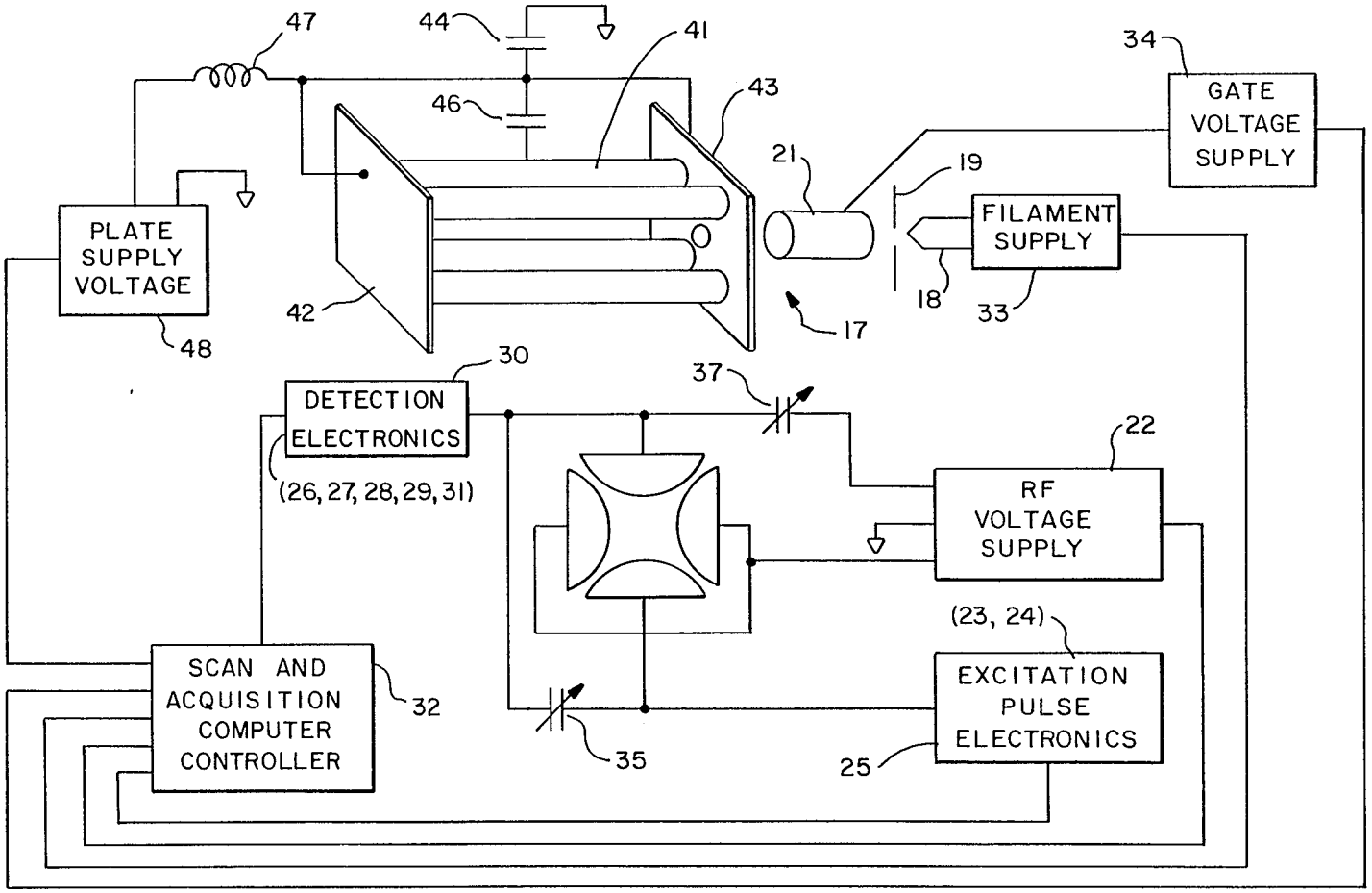
FIG. 5 is a block diagram of a mass spectrometer employing a linear quadrupole structure in accordance with another embodiment of the invention.
Figure 6:
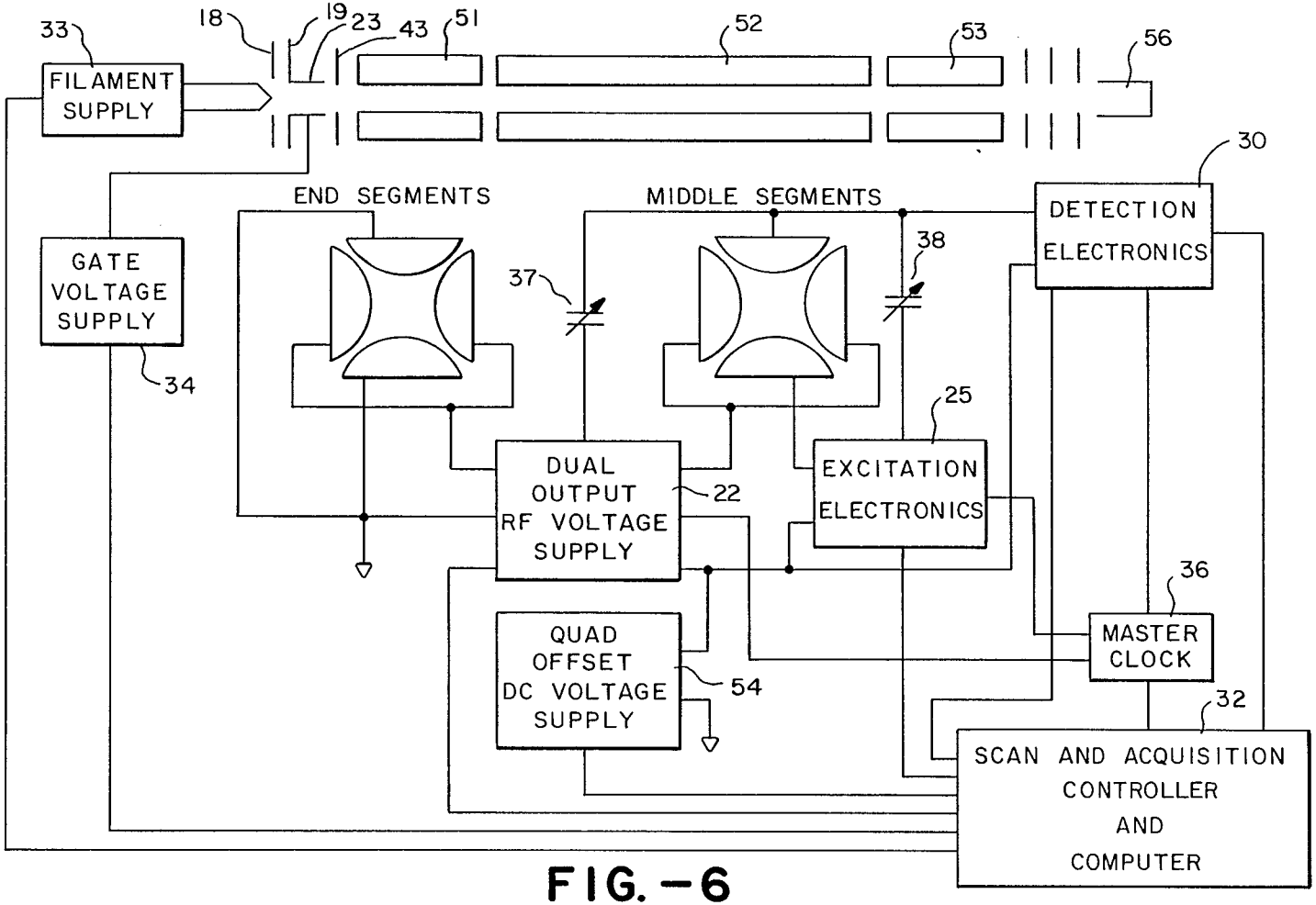
FIG. 6 is a block diagram of another embodiment of the spectrometer shown in FIG. 5.

A Fourier transform RF quadrupole mass analyzing device using a two dimensional quadrupole field may also be constructed. Such devices are shown in FIGS. 5 and 6. In the case of the three dimensional quadrupole field devices, ions are trapped solely by the quadrupole field. In the case of the two dimensional quadrupole field device, trapping of ions is accomplished by using a combination of the RF quadrupole field and a non quadrupolar DC field. The strong focusing RF quadrupole field is used to contain the ions in the x and y dimensions and a weak DC field is used to contain the ions in the z direction. The simplest form of such a trapping device is shown in FIG. 5. It consists of a conventional linear quadrupole rod electrode structure 41 as is used for mass filters with plate electrodes 42,43 closing off the ends of the structure. To trap positive ions the end plates are biased to a slightly positive DC potential relative to the centerline potential of the quadrupole field. This, in effect, creates a shallow flat bottomed DC potential well along the length of the quadrupole structure. This DC potential field prevents ions from escaping out the ends of the structure. If the quadrupole rod structure is symmetrical then the centerline potential for the structure is the average of the voltages applied to the rod pairs. The centerline potential is generally referred to as the quadrupole offset potential or voltage. If this linear quadrupole structure is to be used as a FT mass analyzer a similar electronic apparatus to the one previously described is used. Like reference numbers have been applied to like parts. The quadrupole rod structure is connected in a like manner as in the three dimensional quadrupole structure. Since the RF voltage is applied to only one pair of rods the end plates must be biased at one half the RF voltage applied to the rods in addition to whatever DC level is required to reflect ions back toward the middle of the rod structure. This necessitates the use of a couple of series capacitors 44,46 acting as RF voltage dividers and a RF choke 47 to couple in the DC voltage from an additional voltage supply 48 to provide the proper RF and DC bias for the end plates. The sequence of operation is identical to that described for the three dimensional quadrupole apparatus. The termination of the quadrupole field will cause substantial shifts in the characteristic frequencies of ion motion in the transverse dimensions (x,y) as ions approach and are reflected by the end plates. This causes modulation of the characteristic frequencies of ion motion in the transverse dimensions by the motion of ions back and forth along the z axis. Ion motion along the z axis is oscillatory and the frequency of which is determined largely by the average axial speed of ions and the length of the device. Ions will have a random distribution of axial speeds. Ions with higher axial speeds will spend a larger faction of time in the fringe fields than slower ones. Hence, ions with higher axial speeds will have different average characteristic frequencies of motion in the transverse directions then ions with lower axial speeds. Ions excited to coherent motion in a transverse direction will undergo phase randomization due to the random phasing and frequency of ion motion along the z axis. This should result in shortened induced ion image current transients. The overall effect is increased spectral line width corresponding to decreased mass resolution.

FIG. 6 shows an improved form of a two dimensional RF quadrupole apparatus. Instead of end plates, the quadrupole electrode structure is split into three segments 51,52,53. The same amount of RF voltage from supply 22 is applied to the rods of the end segments as is applied to the rods of the middle segment. To trap positive ions, the DC quadrupole offset of the center section is biased to a small negative voltage relative to the quadrupole offsets of the end sections by supply 54. This creates the desired axial DC potential well. If the end sections are relatively long compared to the $r_o$ of the structure, and the gaps between the sections are very small, the integrity of the RF component of the quadrupole field will be very good throughout the the length of the middle section of the device, where ions are contained, including the regions adjacent to the gaps between rod segments. However, the small difference between the DC offsets of the end sections and the center quadrupole will perturb the DC component of the quadrupole field in the regions adjacent to the gaps between rod segments. This inhomogeneity in the DC part of the quadrupole field will produce dephasing of ions coherently excited for mass analysis and will lead to spectral line broadening. However, magnitude of this effect should be substantially less for this arrangement than for the arrangement with end plates. One could imagine even more elaborate designs with many segments with smaller individual offset differences or in the extreme limit quadrupole rods with resistive coatings to allow application of a continuous DC voltage gradient to generate a smooth z axial potential well that would introduce a minimum amount of inhomogeneity to the transverse quadrupole field.

The reasons for interest in the two dimensional quadrupole field devices are threefold. First, there is a well known technology for building accurate two dimensional quadrupole electrode structures. Secondly, the volume available for ion storage can be increased by lengthening the rod structure rather than by incresing the $r_o$ of the device which necessitates using higher RF voltages. Lastly, the two dimensional quadrupole device seems well suited to injection of ions from an external source such as illustrated at 56 in FIG. 6. Ions could be brought into the device from the axis and stabilized either by collisions or trapped by increasing the DC voltages applied to the end plates or segments. The three dimensional quadrupole traps do not seem to be nearly as well suited to this type of experiment. One could also imagine applying this technique of analysis to a race track RF quadrupole ion trap of Church type (D. A. Church, J. Appl. Phys., 40, 1969, 3127) where the axis of a two dimensional quadrupole is curved into a closed circle or oval. Up to this point the method of analysis herein described has been applied to a single stage of mass analysis. This method is also applicable to MS/MS analysis in a like manner to how these types of experiments are performed with FT ICR instruments and RF quadrupole ion traps operating in the mass selective instability mode. A typical sequence for MS/MS analysis would involve ionization, elimination of unwanted ion masses from the trap by either manipulation of DC and RF quadrupole field or by exciting these ions sufficiently so that they are expelled from the device or by some combination of both methods, excitation of the remaining "parent" ion and allowing it to undergo collisionally induced disassociation and then mass analyzing the resulting fragment or "daughter" ions by the described FT method. Obviously, this process can be repeated to generate and analyze "granddaughter" ions and successive generations of ions as long as a sufficient number of ions remain to allow detection.

Thus, there has been provided a quadrupole mass spectrometer apparatus and method permitting simultaneous mass analysis of a wide range of ion masses.

What is claimed is:

1. A quadrupole mass spectrometer comprising
a quadrupole structure
means for applying an RF voltage to said structure to form an electrostatic trapping field in said structure,
ionizing means for ionizing a sample in said trapping field and forming sample ions with a mass range being trapped in said field,
means for applying a pulse of energy to said trapped ions whose frequency distribution includes frequencies corresponding to characteristic frequencies of motion for the ions in the range of mass-to-charge ratios to be analyzed to cause characteristic motion of said ions, and
means for detecting image currents induced by the characteristic motion of said ions.

2. A quadrupole mass spectrometer as in claim 1, in which said structure is a structure which defines a two dimensional trapping field.

3. A quadrupole mass spectrometer as in claim 1, in which said structure is a structure which defines a three dimensional trapping field.

4. A quadrupole mass spectrometer as in claim 1, including means for applying a D.C. voltage along with the RF voltage to control the electrostatic trapping field so that the range of ion masses which are trapped is controlled.

5. A quadrupole mass spectrometer comprising
a quadrupole structure including spaced end caps and a ring electrode,
means for applying an RF voltage between the ring electrode and at least one end cap to form a three dimentional electrostatic field,
an electron gun means for injecting ionizing electrons into said quadrupole structure to ionize a sample and form ions which are trapped in said field,
excitation pulse means for applying an excitation pulse to at least one of said end caps to cause characteristic motion of said trapped ions, and
detection means connected to at least one end cap for detecting the characteristic motion of ions in said quadrupole structure responsive to said excitation pulse.

6. A quadrupole mass spectrometer as in claim 5, wherein said detection means comprises a high gain amplifier and a digital to analog converter.

7. A quadrupole mass spectrometer as in claim 5, in which said excitation means includes means for applying the excitation pulse across the end caps and said detection means includes means for detecting the current induced by the characteristic motion at both end caps.

8. A quadrupole mass spectrometer as in claim 7 in which said means for applying excitation pulses to said end caps and for detecting the current induced by the characteristic motion comprises a center tapped transformer.

9. A quadrupole mass spectrometer comprising a quadrupole structure including spaced linear quadrupole rods and end plates closing the end of the structure, means for applying an RF voltage between said quadrupole rods, means for applying a DC voltage between end plates wherein said RF and DC voltages form a two dimensional electrostatic field, an electron gun means for providing ionizing electrons into said quadrupole structure to ionize a sample and form ions which are trapped in said field, excitation pulse means for applying an excitation pulse to at least two quadrupole rods to cause characteristic motion of said trapped ions, and detection means connected to at least two of said rods for detecting the characteristic motion of ions in said quadrupole structure responsive to said excitation pulse.

10. A quadrupole mass spectrometer as in claim 9, wherein said detection means comprises a high gain amplifier and a digital to analog converter.

11. A quadrupole mass spectrometer as in claim 9, in which said excitation means includes means for applying the excitation pulse across end plates and said detection means includes means for detecting characteristic motion current at both end plates.

12. The method of mass analyzing ions trapped in a quadrupole spectrometer structure which comprises the steps of applying an RF voltage to the quadrupole structure to form an electrostatic trapping field, ionizing a sample in said trapping field wherein ions over a range of mass-to-charge ratios are trapped, applying an excitation voltage to said quadrupole structure, said excitation voltage including frequencies corresponding to characteristic frequencies of motion of trapped ions in the range of mass-to-charge ratios to be analyzed, detecting, after the excitation voltage has terminated, ion image current induced by characteristic ion motion, and amplifying and recording induced ion currents signals.

13. The method as in claim 12 in which the recorded ion current signals are processed to form a mass spectrum.

14. The method as in claim 12 in which the trapping field is a two dimensional electrostatic field.

15. The method as in claim 12 in which the trapping field is a three dimensional trapping field.

16. The method of mass analyzing ions trapped in a quadrupole spectrometer structure which comprises the steps of applying an RF voltage to the quadrupole structure to form an electrostatic trapping field, ionizing a sample in said trapping field wherein ions over a range of mass-to-charge ratios are trapped, expelling ions of unwanted mass from said trapping field, applying a voltage to said structure which causes the ions to undergo collisionally induced dissociation, applying an excitation voltage to said quadrupole structure, said excitation voltage including frequencies corresponding to characteristic frequencies of motion of dissociated trapped ions in the range of mass-to-charge ratios to be analyzed, detecting, after the excitation voltage has terminated, ion image current induced by characteristic ion motion, and amplifying and recording induced ion currents signals.

17. The method as in claim 16 in which recorded ion current signals are processed to form a mass spectrum.

18. The method as in claim 16 in which the trapping field is a two dimensional electrostatic field.

19. The method as in claim 16 in which the trapping field is a three dimensional trapping field.

* * * * *

UNITED STATES PATENT AND TRADEMARK OFFICE

CERTIFICATE OF CORRECTION

PATENT NO. : 4,755,670

DATED : July 5, 1988

INVENTOR(S) : John E.P. Syka; J. Fies, Jr.

It is certified that error appears in the above-identified patent and that said Letters Patent is hereby corrected as shown below:

Title Page at [54]: In the title of the invention, please delete "FOURTIER" and insert --FOURIER--;

At Column 1, line 1, delete "FOURTIER" and insert --FOURIER--.

Signed and Sealed this

Sixth Day of August, 1991

*Attest:*

HARRY F. MANBECK, JR.

*Attesting Officer*

*Commissioner of Patents and Trademarks*